US008307502B2

(12) United States Patent
Bonomie et al.

(10) Patent No.: US 8,307,502 B2
(45) Date of Patent: Nov. 13, 2012

(54) INTEGRATED HINGE ASSEMBLY

(75) Inventors: Arturo Bonomie, Verona, WI (US); Daniel Mark Graham, Ashville, NY (US)

(73) Assignee: Sub-Zero, Inc., Madison, WI (US)

( * ) Notice: Subject to any disclaimer, the term of this patent is extended or adjusted under 35 U.S.C. 154(b) by 461 days.

(21) Appl. No.: 12/760,308

(22) Filed: Apr. 14, 2010

(65) Prior Publication Data

US 2011/0089801 A1 Apr. 21, 2011

Related U.S. Application Data

(60) Provisional application No. 61/253,388, filed on Oct. 20, 2009.

(51) Int. Cl.
*E05D 7/04* (2006.01)

(52) U.S. Cl. ..... 16/249; 16/248; 16/235; 312/405

(58) Field of Classification Search ..... 16/235, 16/236, 237, 238, 247, 248, 249; 312/405
See application file for complete search history.

(56) References Cited

U.S. PATENT DOCUMENTS

| | | | | |
|---|---|---|---|---|
| 1,185,233 | A | 5/1916 | Minnis | |
| 3,425,766 | A | 2/1969 | Crisera | |
| 3,626,548 | A | 12/1971 | Grünert et al. | |
| 3,863,292 | A | 2/1975 | Grünert et al. | |
| RE30,475 | E | 1/1981 | Heinze, Sr. et al. | |
| 4,332,053 | A * | 6/1982 | Salice | 16/235 |
| 4,338,699 | A * | 7/1982 | Rock | 16/237 |
| 4,517,706 | A * | 5/1985 | Lautenschlager et al. | 16/238 |
| 5,931,554 | A * | 8/1999 | Koopman | 312/405 |
| 6,470,531 | B2 * | 10/2002 | Domenig et al. | 16/246 |
| 6,499,189 | B2 * | 12/2002 | Kondo et al. | 16/239 |
| 6,694,567 | B1 * | 2/2004 | Domenig et al. | 16/238 |
| 6,880,205 | B2 * | 4/2005 | Rupprechter | 16/235 |
| 7,017,231 | B2 * | 3/2006 | Isele | 16/236 |
| 7,213,300 | B1 * | 5/2007 | Domenig et al. | 16/236 |
| 7,543,356 | B2 * | 6/2009 | Zetti | 16/238 |
| 7,614,116 | B2 * | 11/2009 | Chen et al. | 16/238 |
| 7,653,967 | B2 * | 2/2010 | Lowe et al. | 16/238 |
| 2003/0093877 | A1 * | 5/2003 | Hofer | 16/235 |
| 2004/0006846 | A1 * | 1/2004 | Rupprechter | 16/235 |
| 2004/0163211 | A1 * | 8/2004 | Rucker | 16/235 |
| 2005/0188500 | A1 * | 9/2005 | Heid | 16/238 |
| 2006/0156513 | A1 | 7/2006 | Zetti | |
| 2007/0113377 | A1 * | 5/2007 | Brachert | 16/247 |
| 2008/0022491 | A1 * | 1/2008 | Campbell et al. | 16/236 |
| 2008/0104798 | A1 * | 5/2008 | Hoppe et al. | 16/236 |
| 2008/0168618 | A1 | 7/2008 | Hottmann | |
| 2008/0201902 | A1 | 8/2008 | Moon et al. | |
| 2008/0263822 | A1 * | 10/2008 | Sabrowski | 16/236 |
| 2009/0007375 | A1 * | 1/2009 | Frank | 16/238 |
| 2009/0077767 | A1 * | 3/2009 | Alchin | 16/237 |
| 2009/0139055 | A1 * | 6/2009 | Salice | 16/236 |
| 2009/0241288 | A1 * | 10/2009 | Zetti | 16/236 |

FOREIGN PATENT DOCUMENTS

EP 496041 A1 * 7/1992

* cited by examiner

*Primary Examiner* — Jeffrey O Brien
(74) *Attorney, Agent, or Firm* — Bell & Manning, LLC

(57) ABSTRACT

A hinge assembly includes a first member configured to be coupled to a door, a second member configured to be pivotally coupled to the first member, the second member having first and second mounting surfaces, and a mounting bracket configured to be coupled to the body. The mounting bracket may be at least partially located between the first and second mounting surfaces, and the second member may be adjustable relative to the mounting bracket to enable adjustment of the door relative to the body.

19 Claims, 4 Drawing Sheets

INTEGRATED HINGE ASSEMBLY

CROSS-REFERENCE TO RELATED APPLICATIONS

The present application claims priority to U.S. Provisional Application No. 61/253,388, filed Oct. 20, 2009, which is incorporated herein by reference in its entirety.

BACKGROUND

The present disclosure relates generally to the field of hinge assemblies, and more specifically, to an integrated hinge assembly that may be used in connection with an appliance such as a refrigerator, freezer, and so on.

Conventional hinge assemblies for appliances are often used to pivotally couple an appliance door (e.g., a refrigerator door) to an appliance body (e.g., a refrigerator body) such that the door can be moved between an open position and a closed position by pivoting relative to the body via the hinge. There are a wide variety of hinges that may be used with different types of appliances, and there are numerous challenges associated with providing such hinges.

It would be desirable to provide an improved hinge assembly that may provide advantages over more conventional hinges.

SUMMARY

One embodiment relates to a hinge assembly for an appliance having a door and a body, the hinge assembly comprising a first member configured to be coupled to the door; a second member configured to be pivotally coupled to the first member, the second member having first and second mounting surfaces; and a mounting bracket configured to be coupled to the body; wherein the mounting bracket is at least partially located between the first and second mounting surfaces; and wherein the second member is adjustable relative to the mounting bracket to enable adjustment of the door relative to the body.

Another embodiment relates to a refrigerator comprising a body; a door; and a hinge assembly, the hinge assembly pivotally coupling the door to the body, the hinge assembly comprising a door bracket configured to be coupled to the door; a body bracket configured to be pivotally coupled to the door bracket; and a mounting bracket configured to be adjustably coupled to the body bracket and coupled to the body; wherein the mounting bracket comprises a mounting portion extending between two generally parallel members of the body bracket; and wherein the two generally parallel members of the body bracket are moveable relative to the mounting portion to enable adjustment of the door relative to the body.

Another embodiment relates to a hinge assembly for use with an appliance having a door and a body, the hinge assembly comprising an elongated door bracket configured to be coupled to the door; a body bracket pivotally coupled to the door bracket by a pair of links, the links operating in a same plane as one another, the body bracket having first and second mounting members extending generally parallel to the door; and a mounting bracket having a first portion configured to be coupled to the body and a second portion adjustably received between the first and second mounting members.

DETAILED DESCRIPTION OF EXEMPLARY EMBODIMENTS

Figure 1:
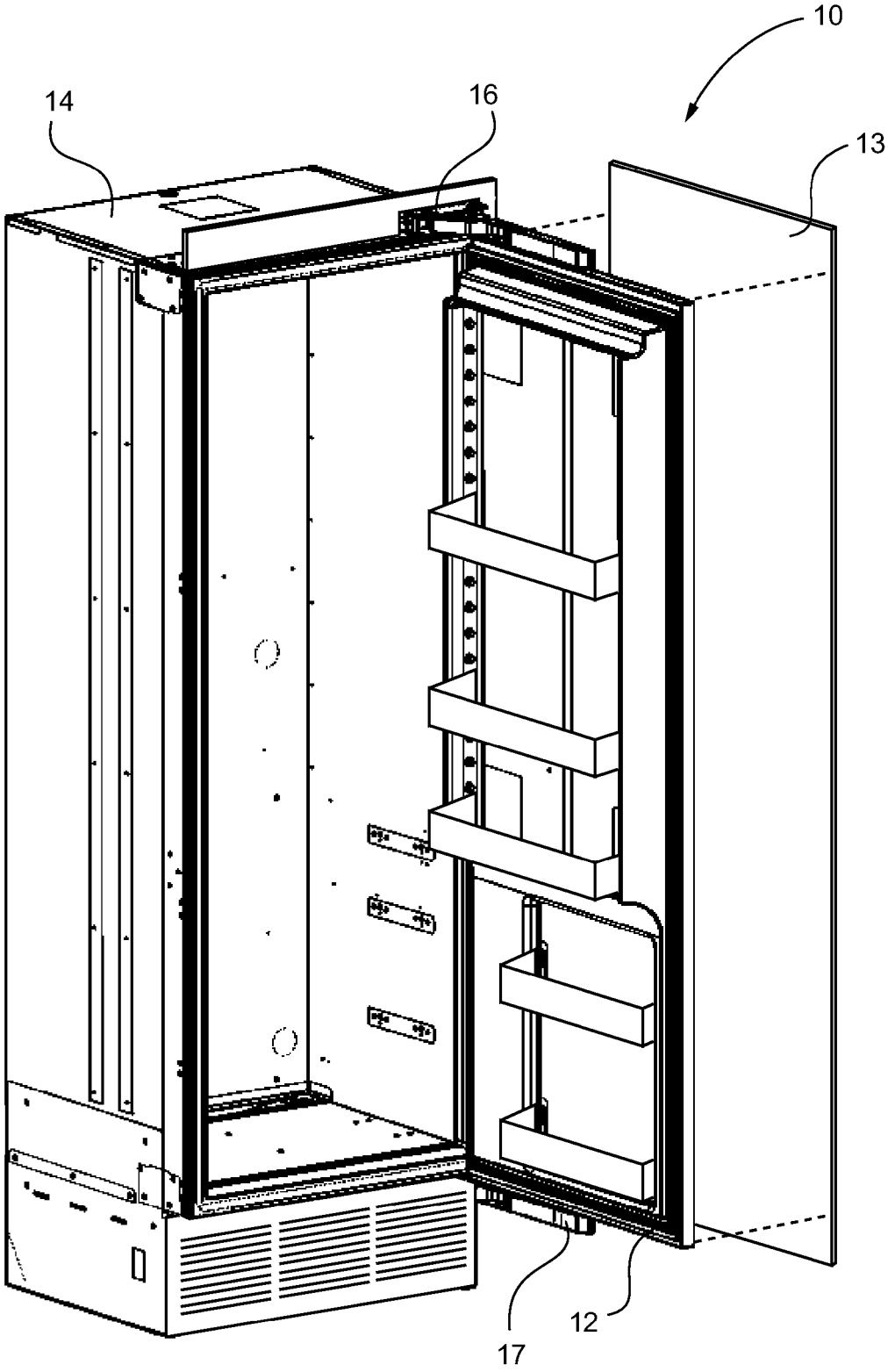
FIG. 1 is a perspective view of an appliance having a hinge assembly according to an exemplary embodiment.

Referring to FIG. 1, an appliance 10 (e.g., a refrigerator, a freezer, a refrigerator/freezer combination, etc.) is shown according to an exemplary embodiment. As shown in FIG. 1, appliance 10 includes a door 12 coupled to a body 14 via hinge assemblies 16, 17. A panel, or cover member, 13 may be coupled to the outside of door 12 and form part of a door assembly. Panel 13 may act to conceal hinges 16, 17 when door 12 is in a closed position. In some embodiments, appliance 10 may include a number of doors (e.g., in a side by side, top/bottom, or other configuration, etc.) and each door may be pivotally coupled by a single or multiple hinges (e.g., a single hinge at a top or bottom portion of the door, a hinge at both the top and bottom portions of the door, etc.). Furthermore, while hinge assembly 16 and/or hinge assembly 17 are generally discussed herein in connection with an appliance such as a refrigerator, it should be understood that hinge assemblies 16, 17 may have applicability outside of the general field of refrigerators, including a variety of non-refrigerator/freezer applications, and the present disclosure is applicable to all such applications.

Figure 2:
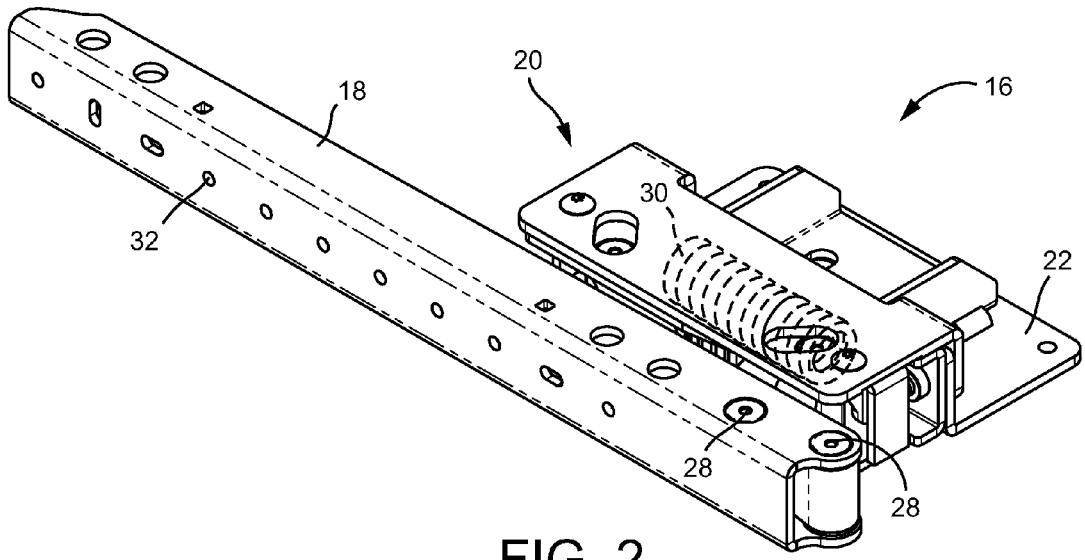
FIG. 2 is a perspective view of a hinge assembly for use with the appliance of FIG. 1 in a closed position according to an exemplary embodiment.
Figure 3:
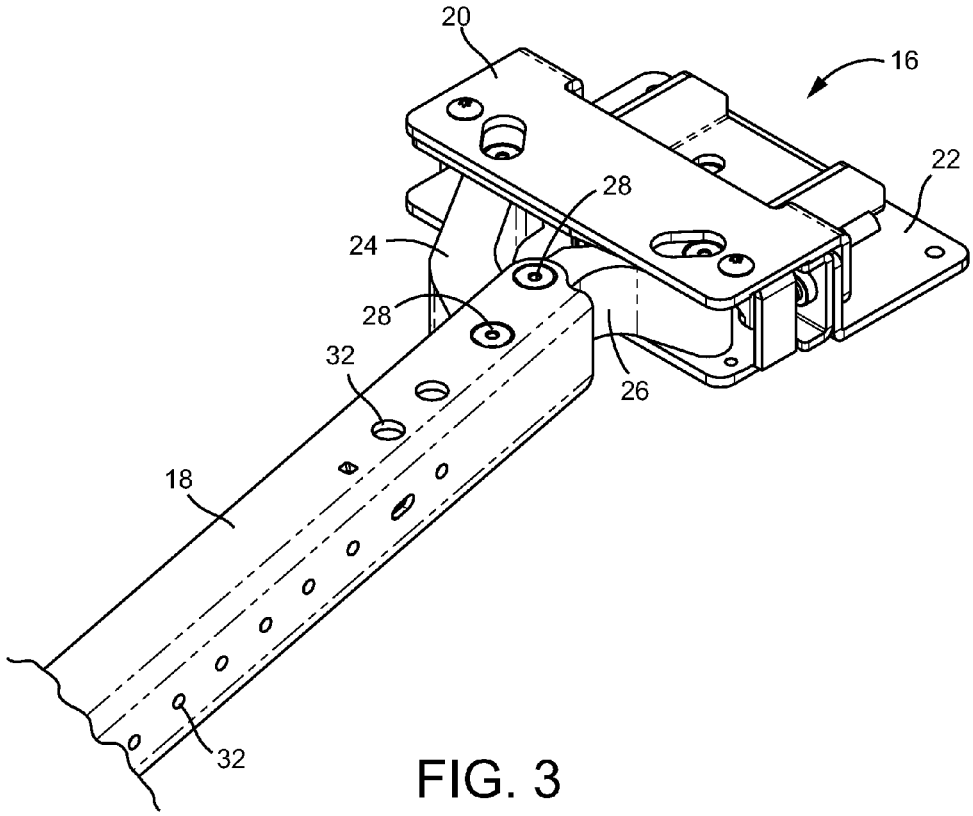
FIG. 3 is a perspective view of the hinge assembly of FIG. 2 in an open position according to an exemplary embodiment.
Figure 4:
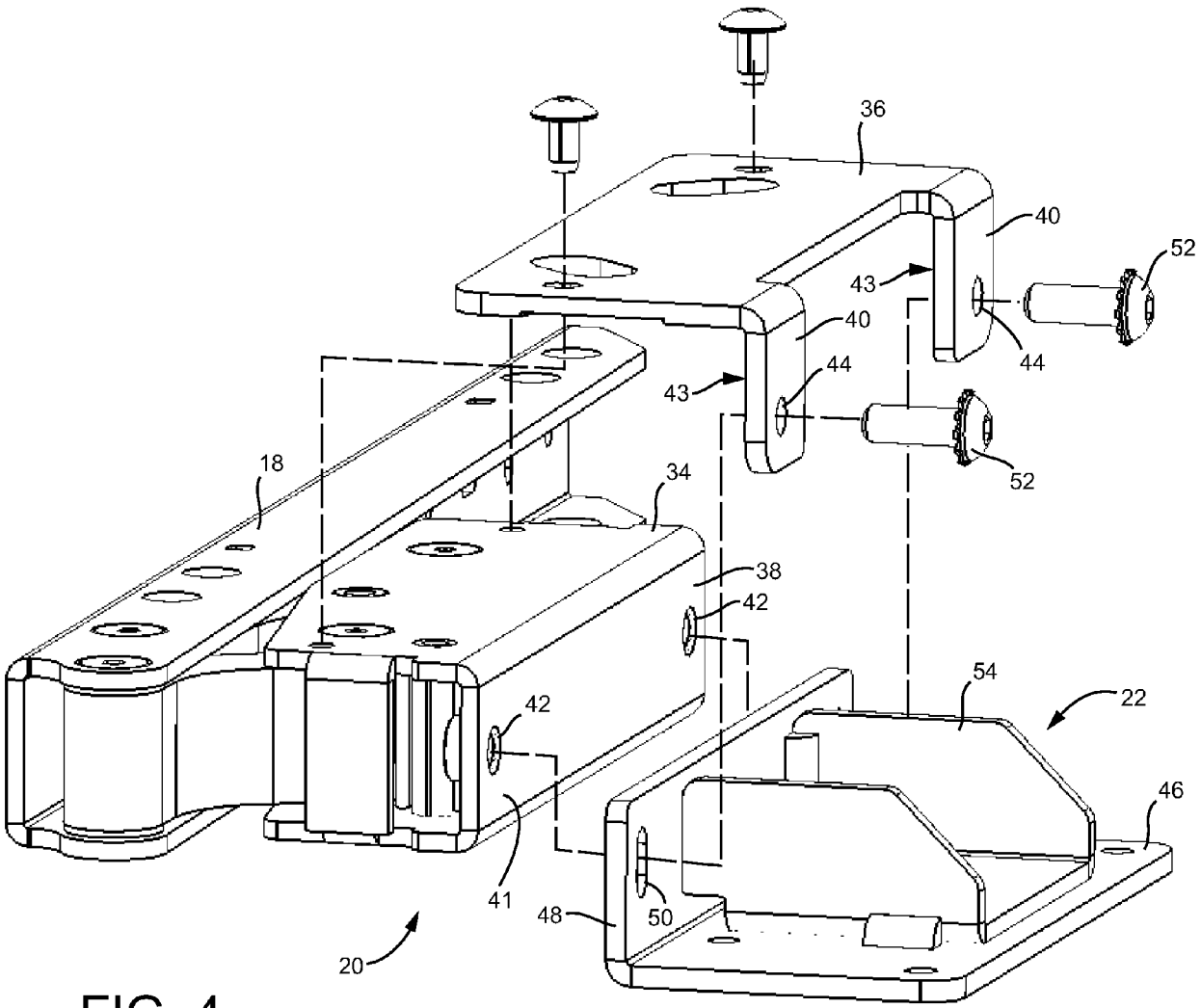
FIG. 4 is an exploded perspective view of the hinge assembly of FIG. 2 according to an exemplary embodiment.

Referring to FIGS. 2-4, hinge assembly 16 is shown in greater detail according to an exemplary embodiment. Hinge assembly 16 includes a first member 18 (e.g., a door bracket, support, channel, etc.), a second member 20 (e.g., a body or frame bracket, a refrigerator bracket, etc.), and a mounting bracket 22 (e.g., a mounting or attachment member or bracket, an adapter plate, etc.). First member 18 is coupled to second member 20 via first and second links 24, 26. In one embodiment, links 24, 26 include a relatively longer link, or arm (e.g., link 24), and a relatively shorter link, or arm (e.g., link 26). Links 24, 26 are each pivotally attached at each end to first member 18 and second member 20 by pins 28 to form a four-bar linkage, such that door 12 is movable in a pivotal or rotating fashion between an open position (e.g., such that the interior of appliance 10 is accessible to users) and a closed position (e.g., such that the interior of appliance 10 is not accessible to users). In some embodiments, hinge assembly 16 may be configured to maintain door 12 at any of a number of intermediate positions between the opened and closed positions. In further embodiments, hinge assembly 16 may be configured to provide a biasing force (e.g., a spring force, etc.) tending to move door 12 toward the open or closed position (e.g., depending on the position of the door).

For example, according to an exemplary embodiment, a biasing member 30 (e.g., a compression spring, etc.) is provided between one end of link 24 and second member 20 such that as door 12 is initially moved from a closed position toward an open position, biasing member 30 provides a closing force to door 12 that tends to force door 12 back to the closed position (e.g., a self-closing mechanism). Once door 12 is opened a sufficient amount, biasing member 30 provides an opening force to door 12 that tends to force door 12 to the open position. According to various alternative embodiments, the positioning and configuration of biasing member 30 may be varied to provide a wide range of opening/closing forces at differing positions along the range of movement of door 12 between the open and closed positions. For example, according to one embodiment, biasing member may provide a force toward one or more "stop positions" where the door tends to remain in position (e.g., 90 degrees opened, 105 degrees opened, etc.) against one or more stop members (not shown).

According to an exemplary embodiment, first member 18 is a generally elongated member having a U-shaped cross-section. One or more mounting holes 32 are provided on first member 18 and are usable, for example, to secure first member 18 to an upper, lower, and/or inner surface or edge of door 12 (e.g., by way of mechanical fasteners such as screws, rivets, etc., or other suitable fastening means, etc.). First member 18 may extend, for example, along a top or bottom portion of a refrigerator door. One or more portions of first member 18 may be concealed from view after installation (e.g., by refrigerator compartments, panels, etc.). For example, panel 13 (see FIG. 1) may be coupled to and/or conceal one or more hinges.

Figure 5:
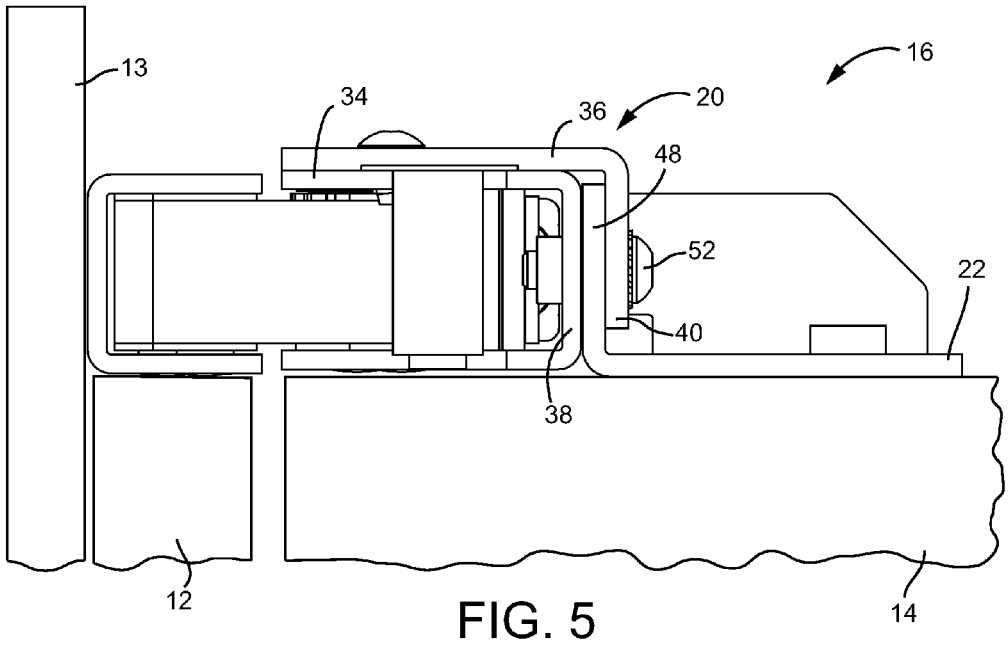
FIG. 5 is a side view of the hinge assembly of FIG. 2 shown at a first height adjustment level according to an exemplary embodiment.
Figure 6:
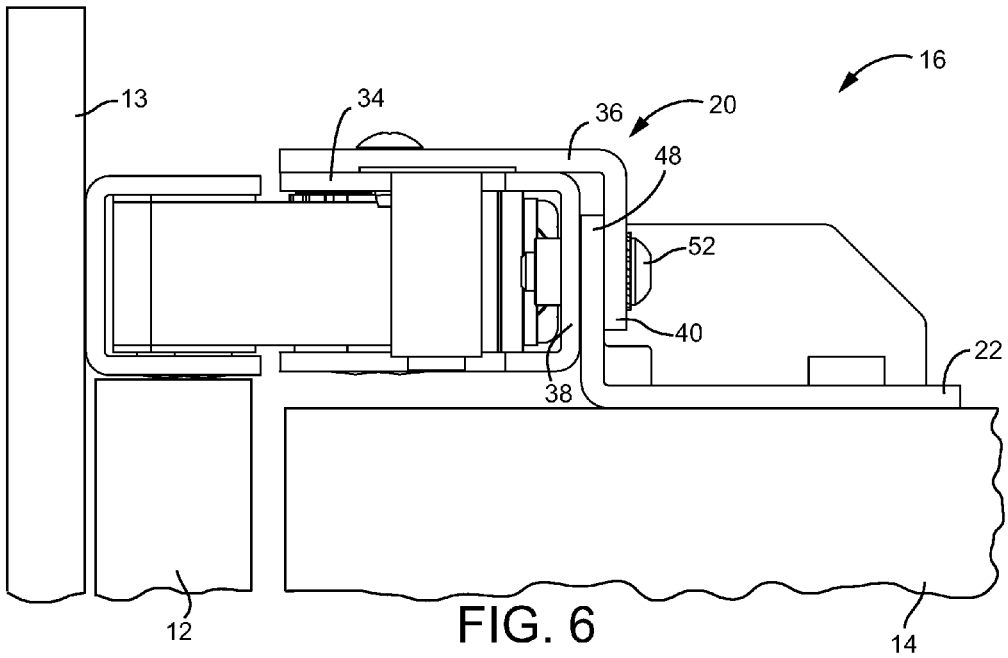
FIG. 6 is a side view of the hinge assembly of FIG. 2 shown at a second height adjustment level according to an exemplary embodiment.

According to an exemplary embodiment, second member 20 comprises a first portion 34 secured to a second portion 36. In one embodiment, first portion 34 is a generally U-shaped member (e.g., a channel, etc.) and second portion 36 is a generally L-shaped member. As shown in FIGS. 4-6, first portion 34 and second portion 36 include generally parallel mounting members 38, 40. Mounting members 38, 40 include generally parallel and opposing mounting surfaces 41, 43. In one embodiment, first and second portions 34, 36 have apertures 42, 44 usable to secure and/or adjust second member 20 and mounting bracket 22.

According to an exemplary embodiment, mounting bracket 22 is configured to be adjustable relative to second member 20 to permit adjustment of door 12 relative to body 14. Mounting bracket 22 comprises a base or first portion 46 and an extension or second portion 48 that form a generally L-shaped member. Base 46 is secured to body 14 (e.g., using fasteners such as screws, bolts, etc., or another suitable fastening means), and extension 48 extends generally vertically between parallel mounting members 38, 40 of second member 20. As shown in FIG. 1, hinge assembly 16 may be mounted to an exterior surface of a refrigerator cabinet, and then covered with various panels, etc., such as panel 13. According to one embodiment, parallel mounting members 38, 40 are configured so as to provide a snug, slidable interface between extension 48 and mounting members 38, 40. Extension 48 extends in a generally perpendicular manner relative to base 46 and includes an elongated slot or aperture 50. In some embodiments, one or more support members, or reinforcement structures 54 may be provided to reinforce mounting bracket 22, and more specifically, to maintain base 46 and extension 48 in proper positions during installation, adjustment, and/or use of door 12. As discussed in further detail below, second member 20 may be adjustable (e.g., movable in a vertical direction, etc.) relative to mounting bracket 22 due to the size differences between elongated slot 50 in mounting bracket 22 and apertures 42, 44 provided in second member 20.

Referring further to FIGS. 2-4, links 24, 26 enable first member 18 (and, in turn, door 12) to rotate relative to body 14 between an open and closed position. According to one embodiment, links 24, 26 are positioned such that they travel in the same plane (e.g., such that a surface of link 24 and a surface of link 26 travel in a common or same plane during movement of door 12 relative to body 14, etc.). Links 24, 26 may be of any appropriate lengths to provide proper movement, pivoting, etc. of door 12 relative to body 14. According to one embodiment, links 24 are configured to be received within portions of first member 18 and second member 20 when door 12 is in the closed position. In some embodiments, one or more stops may be fastened to first member 18 and/or second member 20 to limit the range of motion of one or more of links 24, 26. Furthermore, as discussed above, biasing member 30 (e.g., a spring) may be utilized to provide appropriate opening/closing forces upon door 12 during operation.

Referring to FIGS. 5-6, hinge assembly 16 is shown in different adjusted positions according to an exemplary embodiment. Hinge assembly 16 may be provided in a first, or lower, position (see FIG. 5), or a second, or higher, position (see FIG. 6). As shown in FIG. 5, second member 20 is in a lower-most vertical position relative to mounting bracket 22 (e.g., by moving second member 20 down relative to mounting bracket 22). A fastener 52 (e.g., a set screw, etc.) extends through apertures 42, 44 and slot 50. Because slot 50 is elongated relative to apertures 42, 44, and there is vertical clearance provided between fastener 52 and slot 50, second member 20 is moveable between the lower-most position (as shown in FIG. 5) and the upper-most position (as shown in FIG. 6). In one embodiment, hinge assembly 16 provides a range of adjustment of approximately 0.195 inches, although according to various alternative embodiments, more or less adjustment may be provided by hinge assembly 16. According to various alternative embodiments, second member 20 may be positioned at any intermediate position. Once second member 20 is at a desired position relative to mounting bracket 22, fastener 52 may be fully tightened, securing second member 20 in place relative to mounting bracket 22 (and in turn, securing door 12 in place relative to body 14).

In order to install hinge assembly, 16, a user may first attach first member 18 to door 12. Mounting bracket 22 may then be secured to body 14, while mounting bracket 22 is also loosely fastened to second member 20 using fastener 52. Once first member 18 and mounting bracket 22 are secured, door 12 may be set at a desired position (e.g., a desired height, vertical position, etc.), and fastener 52 may be tightened. Subsequent adjustments of door 12 may be made by loosening fastener 52 and making any desired adjustments to the height of door 12. According to some embodiments, two hinge assemblies 16, 17 may be used for a single door 12. For example, a bottom hinge may be fixed to door 12 and body 14. Subsequently, a top hinge may then be adjusted as discussed herein prior to fixing the top hinge to door 12 and body 14. This may facilitate maintaining the proper parallelism between the upper and lower hinge mechanisms, (e.g., for alignment or realignment purposes). Furthermore, the height adjustment feature of hinge assembly 16 enables users to compensate for limitations on maintaining manufacturing tolerances that may otherwise result in misalignment of parts.

According to an exemplary embodiment, only hinge assembly 16 includes the height-adjustment features described herein, such that hinge assembly 17 provides fixed height-mounting of door 12. However, according to other embodiments, the relative positions of hinge assemblies 16, 17 may be reversed, and/or both of hinge assemblies 16, 17 may provide height-adjustment features such as those disclosed herein.

First member 18, second member 20, and mounting bracket 22 may be made from any suitable material. According to an exemplary embodiment, first member 18, second member 20, and/or mounting bracket 22 are made of a metal material. According to various alternative embodiments, first and second members 18, 20 and mounting bracket 22 may be made from a wide variety of materials, and each may be made from the same or differing materials.

Providing a height adjustment feature such as that described herein may provide advantages over more conventional hinge designs. For example, hinge assembly 16 may be adjusted while first member is coupled to door 12 and mounting bracket is coupled to body 14. In this way, a user may determine the specific desired position of door 12, and need only to secure fastener 52 to secure the components in place relative to one another. Further, hinge assembly 16 provides height adjustability features while remaining out of sight from users while door 12 is closed, unlike many typical hinge designs that rely on externally mounted bushings/shafts that remain in sight when the appliance door is closed. Further yet, the parallel mounting surfaces provided by second member 20 tend to maintain door 12 in a parallel relationship with the front of body 14 during adjustment of the door, avoiding misalignment problems which may otherwise occur.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to a mechanical or fluid relationship between the two components.

It is also important to note that the construction and arrangement of the elements of the hinge assembly as shown in the exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. Accordingly, all such modifications are intended to be included within the scope of the present disclosure as defined in the appended claims. The order or sequence of any process or method steps may be varied or re-sequenced according to alternative embodiments. Other substitutions, modifications, changes and/or omissions may be made in the design, operating conditions and arrangement of the exemplary embodiments without departing from the spirit of the present disclosure.

What is claimed is:

1. A hinge assembly for an appliance having a door and a body, the hinge assembly comprising:

a first member configured to be coupled to the door;

a second member configured to be pivotally coupled to the first member by a link that provides rotation of the first member relative to the second member about an axis of rotation, the second member including a first mounting surface that extends generally parallel to the axis of rotation;

a mounting bracket including a second mounting surface and a third mounting surface that is generally perpendicular to the second mounting surface, wherein the second mounting surface is configured to be coupled to the body and the third mounting surface extends generally parallel to the first mounting surface; and a third member including a fourth mounting surface that extends generally parallel to the first mounting surface, wherein the third mounting surface is coupled between the first mounting surface and the fourth mounting surface;

wherein at least one of the first mounting surface, the third mounting surface, and the fourth mounting surface includes a slot defining a range of adjustment between the second member and the mounting bracket in a direction substantially parallel to the axis of rotation.

2. The hinge assembly of claim 1, wherein the range of adjustment between the second member and the mounting bracket defines a corresponding range of vertical adjustment between the door and the body.

3. The hinge assembly of claim 1, wherein the mounting bracket comprises the slot.

4. The hinge assembly of claim 1, wherein the second member comprises a generally U-shaped member, the third member comprises a generally L-shaped member.

5. The hinge assembly of claim 2, wherein the first and fourth mounting surfaces tend to maintain the door parallel to the third mounting surface of the mounting bracket while the door is adjusted relative to the body.

6. The hinge assembly of claim 1, wherein the hinge assembly is not visible from an exterior of the appliance when the door is in a closed position.

7. The hinge assembly of claim 1, wherein the first member, the second member, and the mounting bracket are configured such that the door is adjustable relative to the body while the first member is coupled to the door and the mounting bracket is coupled to the body.

8. The hinge assembly of claim 1, wherein the second member and the third member are integrally formed as a unitary body.

9. The hinge assembly of claim 1, wherein the second member is further pivotally coupled to the first member via a second link.

10. The hinge assembly of claim 1, further comprising a fastener; wherein the mounting bracket comprises the slot and the first mounting surface and the fourth mounting surface comprise generally circular apertures; and wherein the fastener is configured to extend through the generally circular apertures and through the slot in the mounting bracket.

11. A refrigerator comprising:

a body;

a door; and a hinge assembly, the hinge assembly pivotally coupling the door to the body, the hinge assembly comprising a door bracket coupled to the door;

a body bracket pivotally coupled to the door bracket by a link that provides rotation of the door bracket relative to the body bracket about an axis of rotation, the body bracket including a first mounting surface that extends generally parallel to the axis of rotation;

a mounting bracket including a second mounting surface and a third mounting surface that is generally perpendicular to the second mounting surface, wherein the second mounting surface is coupled to the body and the third mounting surface extends generally parallel to the first mounting surface; and a bracket member including a fourth mounting surface that extends generally parallel to the first mounting surface, wherein the third mounting surface is coupled between the first mounting surface and the fourth mounting surface;

wherein at least one of the first mounting surface, the third mounting surface, and the fourth mounting surface includes a slot defining a range of adjustment between the body bracket and the mounting bracket in a direction substantially parallel to the axis of rotation.

12. The refrigerator of claim 11, wherein the hinge assembly further comprises a fastener;

wherein the mounting bracket comprises the slot and the first mounting surface and the fourth mounting surface comprise generally circular apertures; and wherein the fastener is configured to extend through the generally circular apertures and through the slot in the mounting bracket.

13. The refrigerator of claim 11, wherein the hinge assembly is not visible from an exterior of the refrigerator when the door is in a closed position.

14. The refrigerator of claim 11, wherein the door bracket, the body bracket, the bracket member, and the mounting bracket are configured such that—the door is adjustable relative to the body while the door bracket is coupled to the door and the mounting bracket is coupled to the body.

15. The refrigerator of claim 11, wherein the hinge assembly further comprises a biasing member configured to selectively bias the door toward at least one of an open position and a closed position based on a current position of the door relative to the body.

16. The refrigerator of claim 11, wherein the body bracket comprises a U-shaped member and the bracket member comprises an L-shaped member.

17. The refrigerator of claim 11, wherein the mounting bracket comprises the slot that provides the range of adjustment between the door and the body.

18. The refrigerator of claim 11, wherein the body bracket and the bracket member are integrally formed as a unitary body.

19. The refrigerator of claim 11, wherein the body bracket is further pivotally coupled to the door bracket via a second link.

* * * * *